US006138884A

United States Patent [19]

Gish

[11] Patent Number: 6,138,884

[45] **Date of Patent: *Oct. 31, 2000**

[54] SANDER MATE

[76] Inventor: Robert Gish, 10925 English Rd., Hampton, Ga. 30228

[ * ] Notice: Under 35 U.S.C. 154(b), the term of this patent shall be extended for 441 days.

[21] Appl. No.: 08/772,861

[22] Filed: Dec. 26, 1996

Related U.S. Application Data

[63] Continuation of application No. 08/450,015, May 25, 1995, abandoned.

[51] Int. Cl.[7] ..... B26F 3/00

[52] U.S. Cl. ..... 225/1; 225/92; 33/562

[58] Field of Search ..... 225/91, 92, 17, 225/1; 33/562

[56] References Cited

U.S. PATENT DOCUMENTS

| | | | |
|---|---|---|---|
| 162,516 | 4/1875 | Angell | 225/6 X |
| 180,362 | 7/1876 | Montgomery | 225/6 X |
| D. 263,276 | 3/1982 | Takagi . | |
| D. 296,864 | 7/1988 | Moulton et al. | D8/98 |
| 406,199 | 7/1889 | Cridge | 225/91 X |
| 433,258 | 7/1890 | Thrall | 225/91 X |
| 469,915 | 3/1892 | Stanton, Jr. | 225/6 X |
| 492,354 | 2/1893 | Harrison | 225/81 |
| 1,218,670 | 3/1917 | Kramer | 225/91 X |
| 1,774,823 | 9/1930 | Davis | 225/31 |
| 2,323,048 | 6/1943 | Johnson | 225/91 X |
| 2,642,674 | 6/1953 | Schell, Jr. | 33/527 |
| 3,169,685 | 2/1965 | Reilly | 225/91 X |
| 3,172,587 | 3/1965 | Freeman | 225/91 X |
| 3,460,261 | 8/1969 | Frey | 33/403 |
| 3,797,122 | 3/1974 | Smith | 33/562 X |
| 3,991,922 | 11/1976 | Martin | 225/81 X |
| 4,979,612 | 12/1990 | Melbye | 30/290 X |
| 5,100,039 | 3/1992 | Kingston | 225/91 X |
| 5,511,316 | 4/1996 | Fischer et al. | 33/562 X |

*Primary Examiner*—M. Rachuba
*Attorney, Agent, or Firm*—Robert Platt Bell

[57] ABSTRACT

An apparatus for sizing bulk sandpaper to produce individual sandpaper sheets suitable for use in hand and powered sanders. A planar member, typically made of clear plastic is provided with a number of marked indicia indicating standard sizes for sander sheets. One or more sides of the planar member may be provided with a cutting edge whether attached to or molded onto the planar member. A handle is provided attached to the planar member to hold sandpaper in place for sizing. In use, a user places the device over a sheet of sandpaper on a workbench or the like and aligns the sandpaper to the desired size indicia. Applying mild pressure to the handle, the user may then tear or cut the sandpaper to the desired size. The apparatus may be economically made without multiple or moving parts and may be readily transported in a tool box, pail or the like.

11 Claims, 2 Drawing Sheets

SANDER MATE

This application is a continuation, of application Ser. No. 08/450,015, filed May 25, 1995, now abandoned.

FIELD OF THE INVENTION

The present invention relates to hand tools, particularly for a hand tool for measuring and sizing sheets of sandpaper.

BACKGROUND OF THE INVENTION

In the wood and metal working and constructions arts, it is known to provide manual or powered sanders of various types (e.g., orbital, palm, sanding block or the like) designed to accept sandpaper of a particular size and shape, typically rectangular. The process of sanding may use a considerable amount of sandpaper, forcing the user to frequently change sandpaper in the sander.

Sandpaper manufacturers offer sandpaper in conveniently sized pieces in standard sizes designed to fit typical sanders. However, such pre-cut and pre-packaged sandpaper is often much more expensive than sandpaper purchased in bulk sizes. Moreover, such pre-cut and pre-packaged sandpaper may be typically marketed to the retail consumer for light duty use. Thus, such pre-cut and pre-packaged sandpaper may rely on inferior adhesives and/or sanding compounds such as aluminum oxide, which may be less effective and long-lasting as other sanding compounds such as garnet, carbides, or the like.

Cutting large sheets of sandpaper into convenient sizes for sanders is in itself problematic. Sandpaper, by its nature, tends to quickly dull scissors, razors, knife edges or the like. Moreover, measuring sandpaper by hand for a particular cut size may be time-consuming and inaccurate. Folding large sheets of sandpaper to fit into a sander may be unacceptable, as the sandpaper may wrinkle, creating sanding marks in work.

In the prior art, several attempts have been made to provide an apparatus which may quickly and easily size sandpaper for a particular size sander. Moulton et al., U.S. Design Pat. Des. 296,864, issued Jul. 6, 1988 shows a Design patent for a Sandpaper Cutter. While it is difficult to ascertain the functionality of a Design Patent, it appears that Moulton shows what appears to be a clear plastic planar surface with a toothed cutting edge. It is difficult to ascertain whether the design of Moulton is intended to be placed over or underneath a piece of sandpaper.

The presence of what appears to be countersunk holes in the Moulton device may lend credence to the theory that the apparatus is design to be mounted to a workbench or the like and sandpaper placed over the device for tearing. The top of the Moulton device appears to be recessed for this or another purpose. The bottom of the Moulton device appears to have a longitudinal rib and three lateral ribs formed thereon for an undisclosed purpose.

If the ascertained functionality of Moulton is correct, it appear that the apparatus of Moulton may suffer from several shortcomings. First, a user may wish to cut or tear a rectangular sheet of sandpaper from the corner of a larger sheet. As the apparatus of Moulton appears to have only one serrated edge, it may be difficult to perform such a corner cut. Moreover, it does not appear that the Moulton device may be readily portable if bench mounted, or that the Moulton device readily allows for sizing of sandpaper to a number of different standard sizes.

Freeman, U.S. Pat. No. 3,172,587, issued Mar. 9, 1965, discloses a Sandpaper Tearing Guide. Freeman discloses a base element 11 (FIG. 2) with a cutter block 12 (FIG. 4) slidably and rotatably attached to base block 11. Sandpaper may be placed within base element 11 secured by leaf spring 19. Cutting block 12 may be positioned over the sandpaper and used as a tearing guide to cut the sandpaper into individual sheets suitable for use in a sander or sanding block.

Freeman also provides for cutting or tearing sandpaper along only one line, thus making a corner cut difficult. Moreover, the apparatus of Freeman contains several parts and a hinge mechanism, making the overall apparatus complex, costly, heavy and bulky. With a moving hinged cutting block, the apparatus of Freeman may arguably be more readily breakable than a single piece deign.

Martin, U.S. Pat. No. 3,991,922, issued Nov. 16, 1976, discloses an abrasive sheet measuring and cutting board comprising a portable base member with grooved measuring locations (FIG. 2) and a serrated cutting edge. Sandpaper may be placed on the cutting board at a predetermined location and torn along the cutting edge.

Martin eliminates the moving parts of Freeman. However it appears that the apparatus of Martin also may cut only along one edge, and thus may not readily make corner cuts. Moreover, as the sandpaper must be carefully positioned in a shallow groove and held in place for sizing, it appears that the Martin apparatus may be somewhat difficult to use. In addition, as the apparatus comprises a fairly large wooden base, the device may be somewhat bulky and heavy, and not readily transportable, for example, in a tool box or pail.

SUMMARY AND OBJECTS OF THE INVENTION

An apparatus for sizing sandpaper from bulk sheets into sander-sized sheets comprises a substantially planar member having a substantially regular rectangular shape and a handle on a top surface of the substantially planar member for positioning and holding by hand the substantially planar member on top of a bulk sheet of sandpaper on a substantially planar surface. The handle may be integrally molded to the substantially planar surface or attached using adhesive or fasteners. At least one tearing edge is provided on the substantially planar member for tearing a bulk sheet of sandpaper held beneath the planar surface. The tearing edge may comprises a sharpened or serrated metal edge affixed to at least one edge of the substantially planar surface.

Indicia are formed on a surface of the substantially planar member for positioning and measuring a bulk sheet of sandpaper held beneath the substantially planar member to a predetermined sander size. The substantially planar member may comprise a translucent or transparent substantially planar member such that the indicia may be aligned with the bulk sandpaper beneath the substantially planar member. The indicia may be formed on the top surface of the substantially planar member or on a bottom surface of the substantially planar member.

It is an object of the present invention to provide an easy-to-use apparatus for sizing bulk sandpaper into individual sander-sized sheets.

It is a further object of the present invention to provide an inexpensive apparatus for sizing bulk sandpaper into individual sander-sized sheets.

It is yet a further a object of the present invention to provide a relatively small and lightweight apparatus for sizing bulk sandpaper into individual sander-sized sheets.

It is yet a further a object of the present invention to provide an apparatus for sizing bulk sandpaper into individual sander-sized sheets which may cut a rectangular corner piece from a sheet of bulk sandpaper.

BRIEF DESCRIPTIONS OF THE DRAWINGS

DETAILED DESCRIPTION OF THE INVENTION

Referring now to FIGS. 1–4. The apparatus of the present invention may be readily molded of clear plastic or the like (e.g., PLEXIGLASS™, GE LEXAN™, Polycarbonate, Acrylic Plastic or the like) in one piece or as an assemblage of multiple pieces attached using glue, screws or the like. In the preferred embodiment, the apparatus comprises planar member 100 having a handle 200 integrally molded therein.

Planar member 100 may have an overall size of approximately twelve inches by six inches however, other sizes may be utilized to accommodate a larger or smaller desired cut sheet sizes without departing from the spirit and scope of the present invention. Moreover, although English inch measurements are disclosed herein, the present invention may also be provided with metric dimensions and printed indicia for sizing sandpaper according to metric dimensions.

Figure 1:
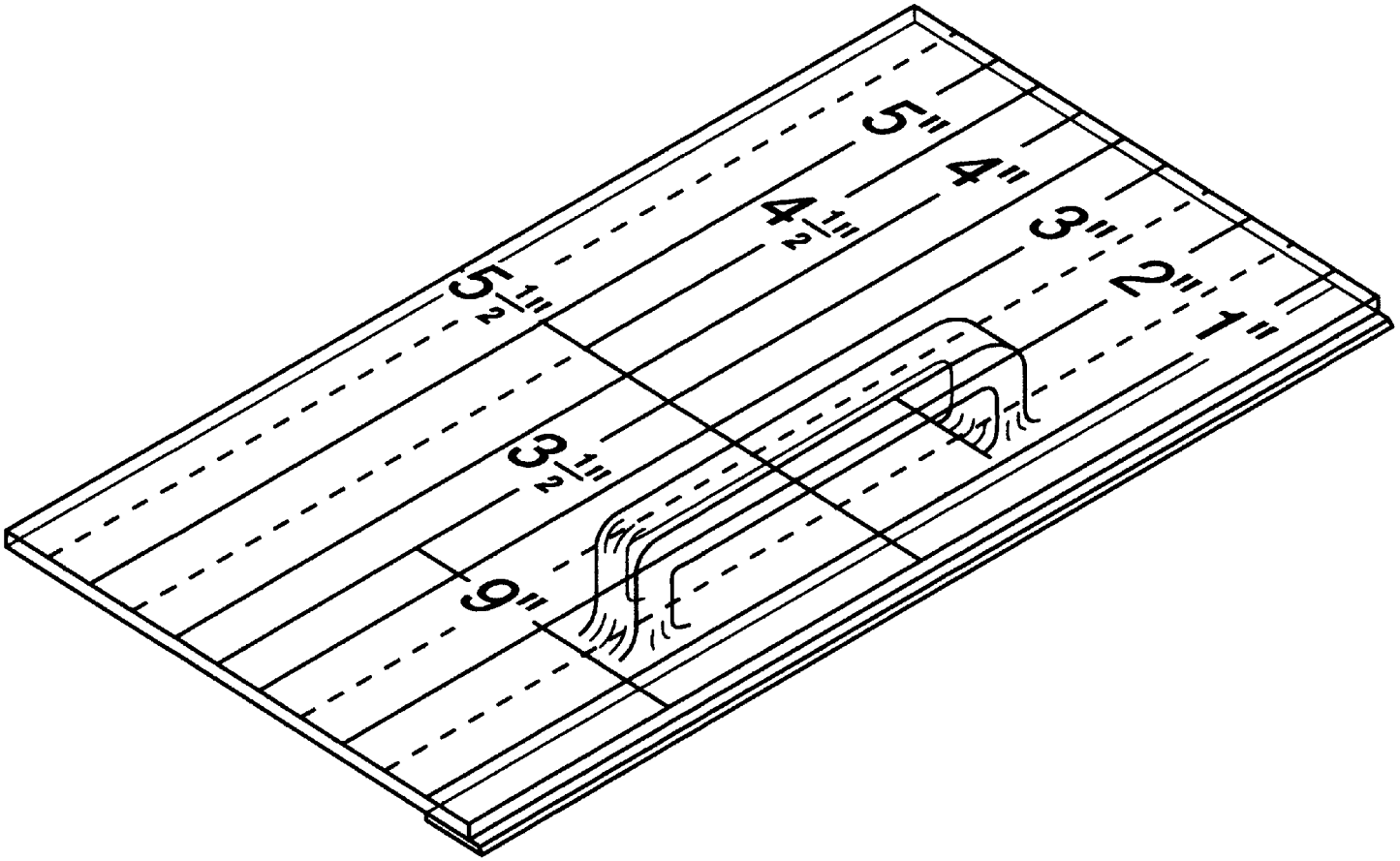
FIG. 1 is an perspective view of the sandpaper sizing device of the present invention.

Printed or molded indicia 210, 211, 212, 213, 214, 230, 240, may be provided on either or both of the top or bottom surfaces of planar member 100. Such printed or molded indicia may be placed on planar member 100 by silk-screening or other printing techniques, or by molding or machining into the surface of planar member 100. The printed or molded indicia, 230, 240 as illustrated in FIG. 1, may include a number of solid or dashed lines corresponding to predetermined standard sandpaper sizes for hand or powered sanders. Numbers, letters or other designations 210, 211, 212, 213, 214 may be utilized to identify different sandpaper sheet size dimensions. Moreover, different size dimensions may be provided with different colored indicia 230, 240 to aid in readily identifying particular indicia for a sheet size.

Planar member 100 may be provided with a tearing edge 300. Tearing edge 300 may be molded into planar member 100 or machined into one or more edges of planar member 100. Although illustrated in FIG. 1 as being applied to one side of planar member 100, tearing edge 300 may be provided on multiple edges of planar member 100 to provide a tearing/cutting edge for multiple sandpaper sizes or for corner cuts in a sandpaper sheet.

In the preferred embodiment, tearing edge 300 may comprise a steel or other type of metal or sharp plastic edge attached to planar member by screws, adhesive or the like. Alternately, tearing edge 300 may comprise a metal or other type of edge molded into planar member 100 during a forming process. In an alternative embodiment, tearing edge 300 may comprise a sharpened or serrated edge of planar member 100.

Tearing edge may comprise a continuous sharp edge (e.g., knife type blade) or may be serrated to aid in tearing. A suitable prototype may be made, for example, from a portion of a hacksaw blade or the like.

In operation, a user may place a sheet of bulk sandpaper (e.g., 12" by 12" sheet) face down on a flat, stable surface (e.g., workbench or the like). The apparatus of the present invention may then be placed atop the sandpaper using handle 200. Printed indica for a selected sander sheet size may then be aligned with an edge of the bulk sheet of sandpaper. Mild pressure may be applied to handle 200 by a user to hold the bulk sandpaper in place while gently tearing the bulk sandpaper along tearing edge 300 by pulling up on the bulk sandpaper.

The portion of bulk sandpaper remaining beneath the apparatus of FIG. 1 will be sized according to the preselected dimension corresponding to the printed indicia. A second tearing operation may be used to size the sanding sheet along another axis. Alternately, the bulk sandpaper may be torn along two or more edges of the apparatus to produce a sanding sheet cut from a corner of a bulk sandpaper sheet.

Using the apparatus of the present invention, a user may quickly reduce a number of bulk sheets of sandpaper into a plurality of individual sized sanding sheets. The cost of such an apparatus may be readily recaptured in the savings produced by sizing only a few sheets of bulk sandpaper. The apparatus of the present invention may be readily injection molded or the like so as to be produced at a very low cost.

Figure 4:
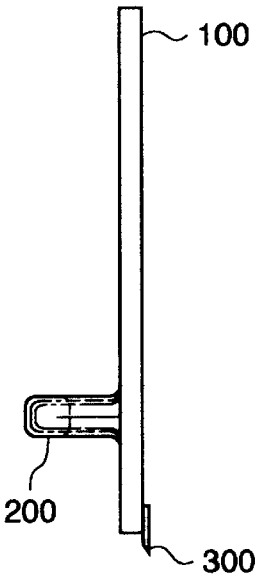
FIG. 4 is an end view of the sandpaper sizing device of the present invention.
Figure 2:
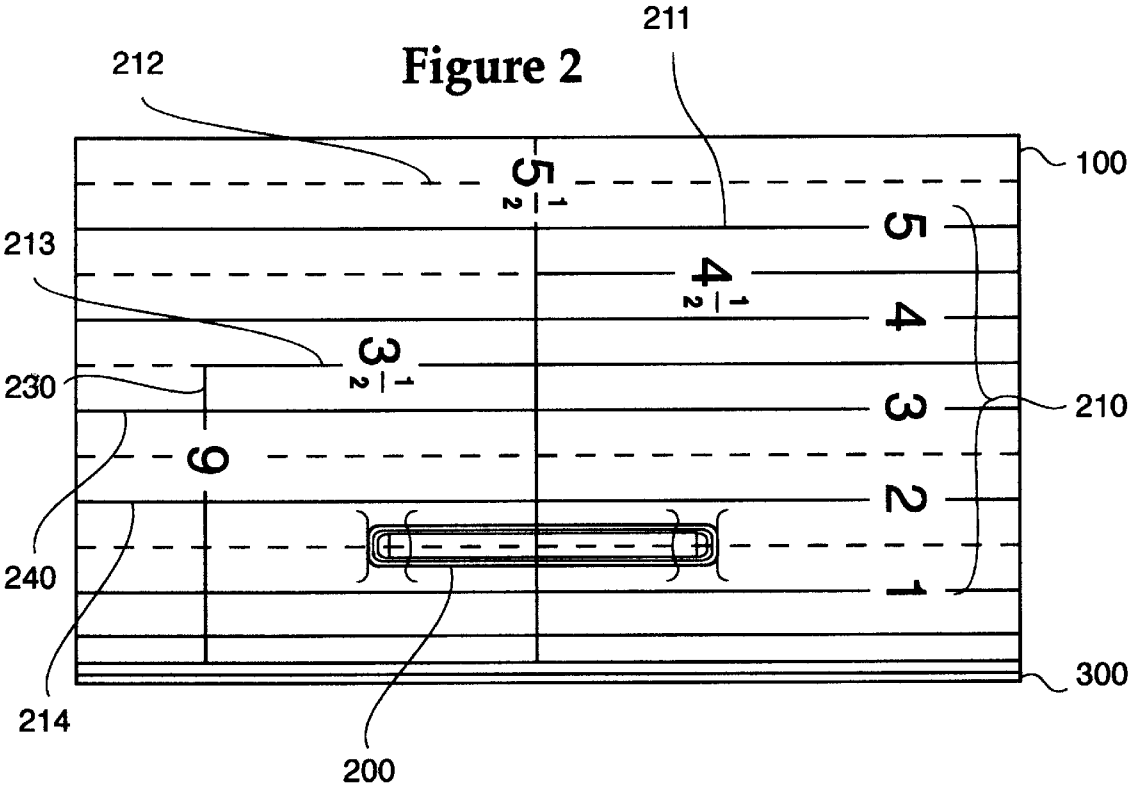
FIG. 2 is a top view of the sandpaper sizing device of the present invention.
Figure 3:
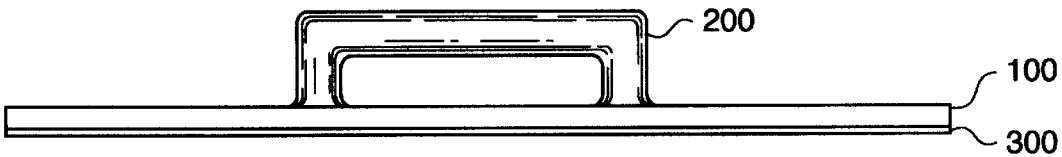
FIG. 3 is a side view of the sandpaper sizing device of the present invention.

FIG. 3 is a side view of the sandpaper sizing device of the present invention. The other side view of the sizing device of the present invention identical to that of FIG. 3. FIG. 4 is an end view of the sandpaper sizing device of the present invention. The other end view of the sandpaper sizing device of the present invention is a mirror image of FIG. 4. The bottom view of the apparatus of the present invention is substantially planar.

While the preferred embodiment and various alternative embodiments of the invention have been disclosed and described in detail herein, it may be apparent to those skilled in the art that various changes in form and detail may be made therein without departing from the spirit and scope thereof.

For example, while the apparatus of the present invention is shown having a rectangular planar surface, other shapes may be utilized to facilitate sizing of sander sheets into other shapes and sizes. Moreover, although shown here as made of a clear plastic material, other types of transparent, translucent or opaque materials may be suitable used. For an opaque material, a suitable window or the like may be provided to align sandpaper.

Alternately, an opaque apparatus of the present invention may be constructed so as to size sandpaper sheets into one sander size by using the edges of the opaque planar surface as measuring guides. For example, a 3½" by 9" planar surface may be suitable for sizing sandpaper to 3½by 9" sander sizes.

What is claimed is:

1. An apparatus for sizing sandpaper from bulk sheets into sander sized-sheets, comprising:

a substantially flat planar translucent member having a substantially rectangular shape;

a handle on a top surface of said substantially flat planar translucent member, for positioning and holding by hand said substantially flat planar translucent member on top of a bulk sheet of sandpaper on a substantially flat planar surface;

a plurality of measuring indicia formed across and on a surface of said substantially flat planar translucent member including a central portion thereof within a periphery of said substantially flat planar translucent member, such that when positioning an edge of a bulk sheet of sandpaper beneath said substantially flat planar translucent member aligned with one of said plurality of indicia, said one of said plurality of indicia define a portion of the bulk sheet of sandpaper to a predetermined sander-size; and at least one tearing edge on said substantially flat planar translucent member, for tearing the portion of the bulk sheet of sandpaper held beneath said substantially flat planar translucent member into a sander-sized sheet, said at least one tearing edge comprising a sharpened metal edge affixed to at least one edge of said substantially flat planar translucent member.

2. The apparatus of claim 1 wherein said tearing edge comprises a serrated metal edge affixed to at least one edge of said substantially planar surface.

3. A method for sizing sandpaper from bulk sheets into sander-sized sheets, comprising the steps of:

positioning and holding by hand a substantially flat planar member on top of a bulk sheet of sandpaper on a substantially flat planar surface;

aligning an edge of the bulk sheet of sandpaper held beneath the substantially flat planar member to a plurality of indicia formed across and on a surface of said substantially flat planar member including a central portion thereof within a periphery of said substantially flat planar member, such that when positioning an edge of a bulk sheet of sandpaper beneath said substantially planar member aligned with one of said plurality of indicia, said one of said plurality of indicia define a portion of the bulk sheet of sandpaper to a predetermined sander-size; and tearing the bulk sheet of sandpaper held beneath the flat planar member on the substantially flat planar member to form a single sander-sized sheet of sandpaper beneath the substantially flat planar member.

4. The method of claim 3, wherein the substantially planar member comprises a translucent substantially planar member.

5. The method if claim 3, wherein the substantially planar member comprises a transparent substantially planar member.

6. The method of claim 5 wherein the indicia are printed on the top surface of the substantially planar member.

7. The method of claim 5 wherein the indicia are printed on a bottom surface of the substantially planar member.

8. The method of claim 5 wherein said step of positioning and holding by hand a substantially planar member on too of a bulk sheet of sandpaper on a substantially planar surface further comprises the step of positioning the substantially planar member using a handle integrally molded to the substantially planar member.

9. The method of claim 5 wherein said step of positioning and holding by hand a substantially planar member on top of a bulk sheet of sandpaper on A substantially planar surface further comprises the step of positioning the substantially planar member using a handle attached to the substantially planar member.

10. The method of claim 5 wherein said step of tearing the bulk sheet of sandpaper further comprises the step of tearing the bulk sandpaper along a sharpened metal tearing edge affixed to at least one edge of the substantially planar member.

11. The method of claim 5 wherein said step of tearing further the bulk sheet of sandpaper comprises the step of tearing the bulk sandpaper along a serrated metal edge affixed to at least one edge of the substantially planar member.

* * * * *